US007273444B2

(12) United States Patent
Chang

(10) Patent No.: US 7,273,444 B2
(45) Date of Patent: Sep. 25, 2007

(54) SWIM TRAINING APPARATUS

(76) Inventor: Chihming Chang, P.O. Box 20-67, Hua-Lien 970 (TW)

( * ) Notice: Subject to any disclaimer, the term of this patent is extended or adjusted under 35 U.S.C. 154(b) by 119 days.

(21) Appl. No.: 11/228,050

(22) Filed: Sep. 15, 2005

(65) Prior Publication Data

US 2007/0060452 A1 Mar. 15, 2007

(51) Int. Cl.
*A63B 31/00* (2006.01)

(52) U.S. Cl. ..... 482/55; 434/254

(58) Field of Classification Search ..... 482/51, 482/55, 56, 111, 121, 124, 129; 434/254; 441/116, 129, 136; 114/215; 273/DIG. 19
See application file for complete search history.

(56) References Cited

U.S. PATENT DOCUMENTS 3,445,941 A * 5/1969 Burke et al. ..... 434/254
4,044,415 A * 8/1977 Wood ..... 441/75
5,083,522 A * 1/1992 Ashrow ..... 114/215
5,391,080 A 2/1995 Bernacki et al.
5,846,167 A * 12/1998 Liu et al. ..... 482/55
6,176,815 B1 * 1/2001 Riera ..... 482/55
6,409,634 B1 6/2002 Profaci
6,634,993 B1 10/2003 Morr
6,966,870 B2 * 11/2005 Lan ..... 482/55
2002/0077010 A1 6/2002 Lukas
2003/0162635 A1 8/2003 Milton
2005/0026518 A1 2/2005 Bolster
2005/0209061 A1 * 9/2005 Crawford et al. ..... 482/54

* cited by examiner

*Primary Examiner*—Lori Amerson
*Assistant Examiner*—Tam Nguyen
(74) *Attorney, Agent, or Firm*—Yi-Ming Tseng

(57) ABSTRACT

One embodiment of the present invention is a swim training apparatus that includes: (a) an arm; (b) a strap adapted to surround at least a portion of a user; (c) a positioner adapted to be disposed at various positions along at least a portion of the arm; and (d) a suspension member that comprises a first end and a second end, wherein: (i) the first end is connected to the positioner, and (ii) the second end is connected to the strap.

23 Claims, 9 Drawing Sheets

SWIM TRAINING APPARATUS

TECHNICAL FIELD OF THE INVENTION

One or more embodiments of the present invention relate to a swim training apparatus.

BACKGROUND OF THE INVENTION

Presently, typical swim training apparatus include guide mechanisms adapted to improve a swimmer's posture or stroke, or include retractable or restraining mechanisms adapted to improve the swimmer's strength or speed. Such swim training apparatus typically require the swimmer to keep himself/herself afloat.

An experienced swimmer typically relies on water buoyancy and swimming technique to stay afloat in order to breathe from time to time while swimming. However, a novice swimmer tends to struggle in the water, and staying afloat poses physical and psychological challenges. Having difficulty in staying afloat often discourages, frustrates, or exhausts the novice swimmer, and therefore keeps the novice swimmer from enjoying swimming and making progress in training. More dangerously, having difficulty in staying afloat could cause injury to, or even drowning of, the swimmer.

In light of the above, there is a need in the art for a swim training apparatus that solves one or more of the above-identified problems.

SUMMARY OF THE INVENTION

One or more embodiments of the present invention solve one or more of the above-identified problems. In particular, one embodiment of the present invention is a swim training apparatus that comprises: (a) an arm; (b) a strap adapted to surround at least a portion of a user; (c) a positioner adapted to be disposed at various positions along at least a portion of the arm; and (d) a suspension member that comprises a first end and a second end, wherein: (i) the first end is connected to the positioner, and (ii) the second end is connected to the strap.

DETAILED DESCRIPTION

Figure 1:
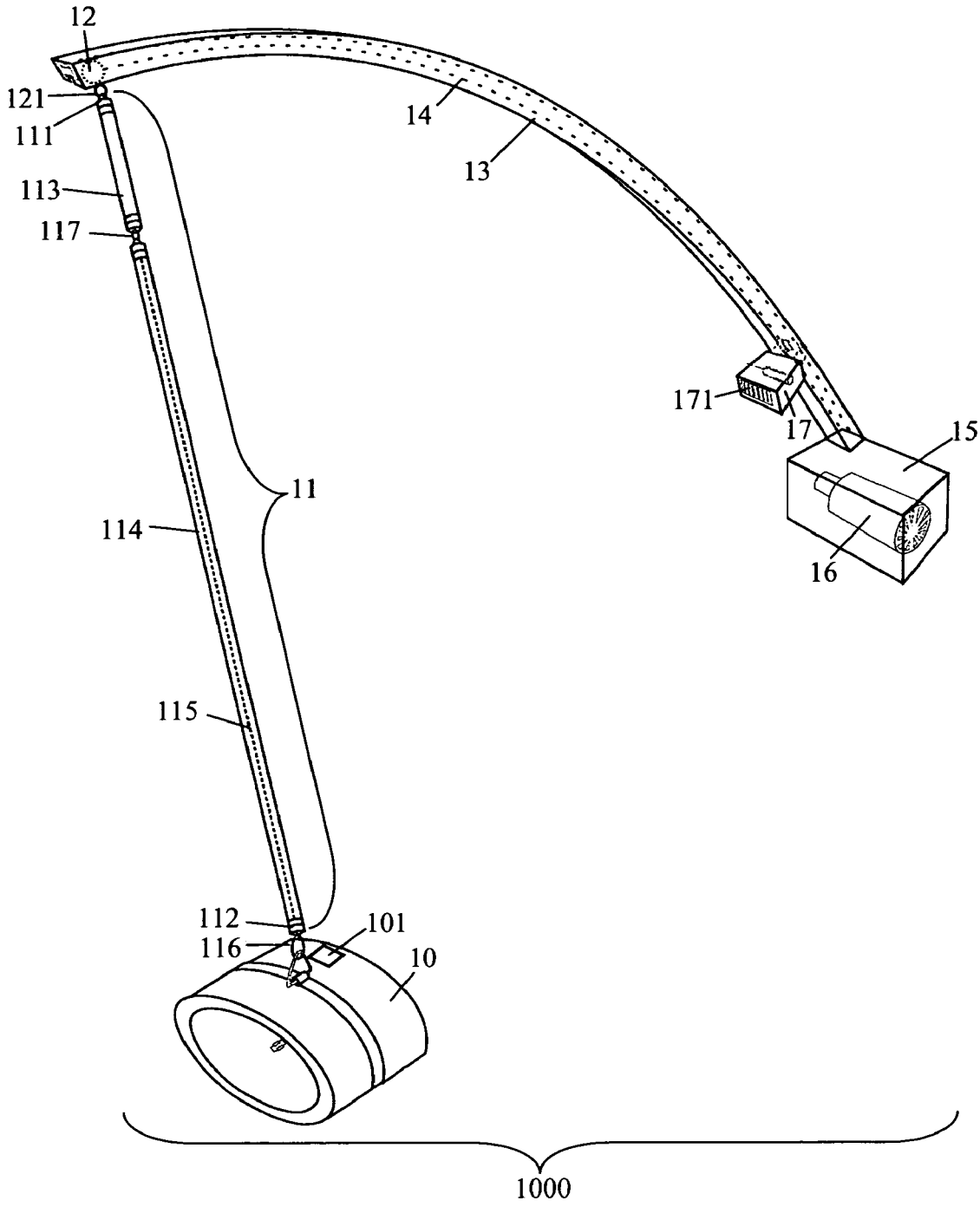
FIG. 1 shows a perspective view of a swim training apparatus that is fabricated in accordance with one or more embodiments of the present invention.
Figure 4A:
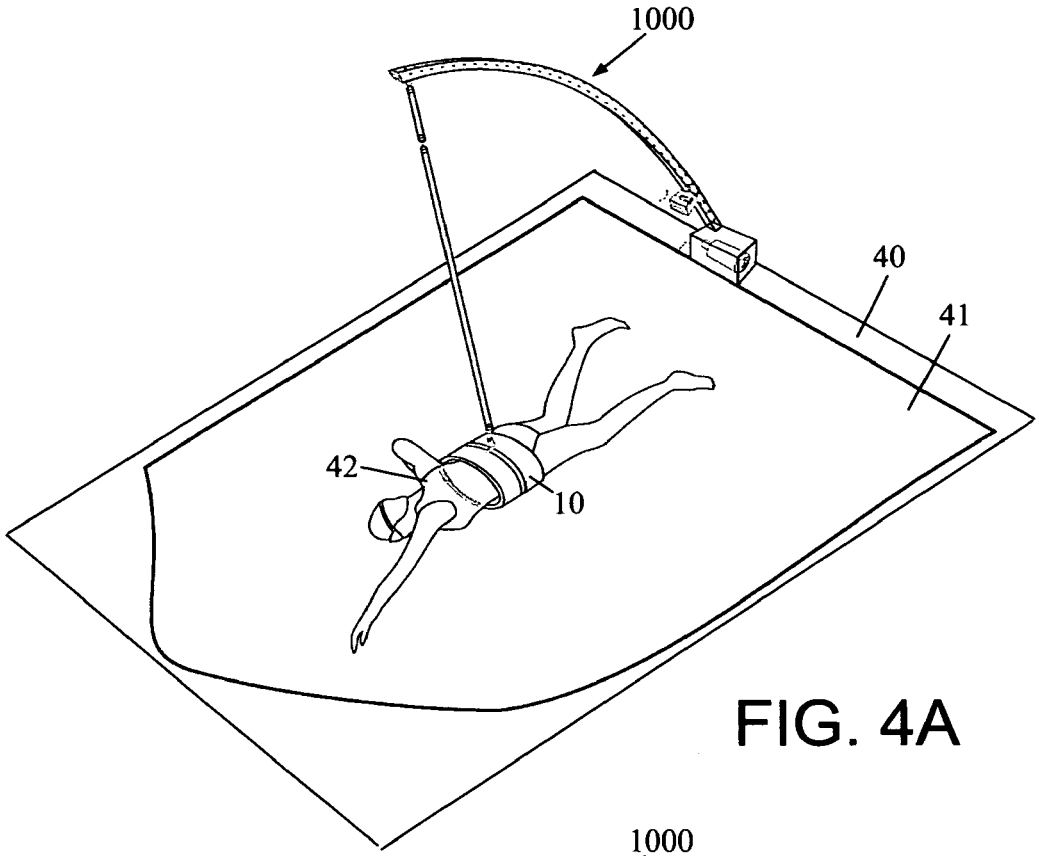
FIGS. 4A, 4B, and 4C show the swim training apparatus of FIG. 1 in use in three user supporting modes, which user supporting modes correspond to the three different positions of the positioner shown in FIGS. 3A, 3B, and 3C, respectively.
Figure 4B:
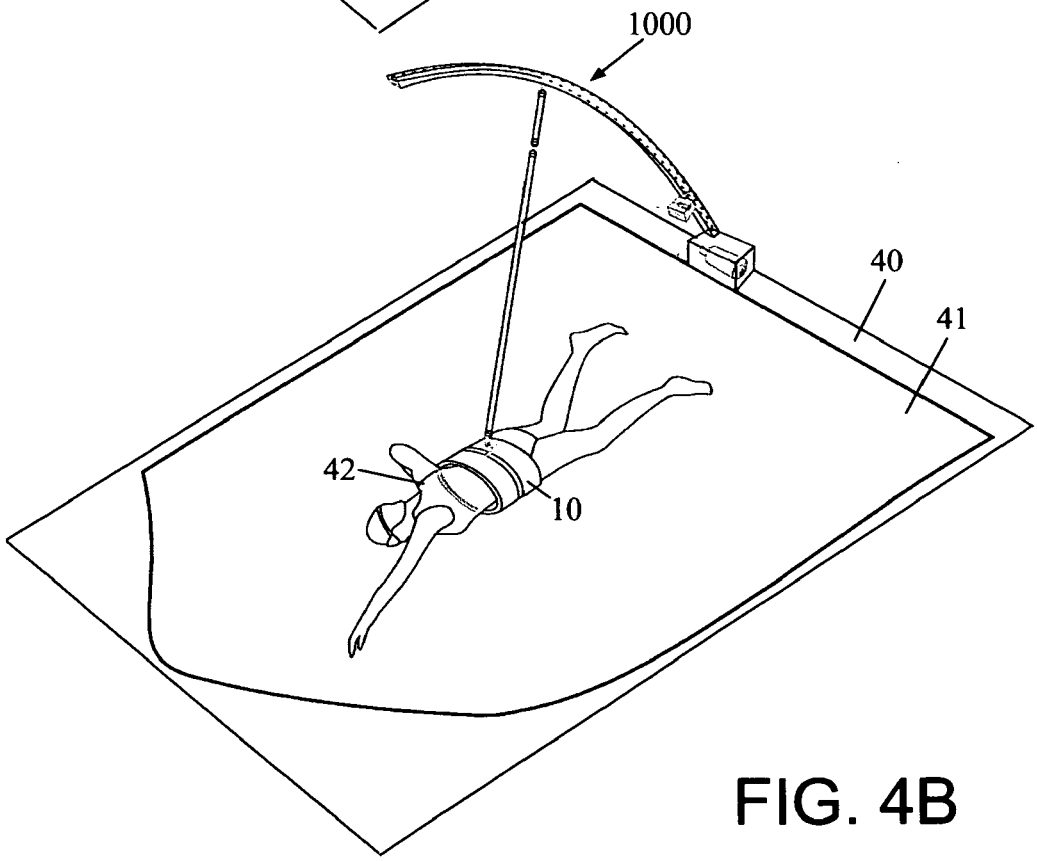
Figure 4C:
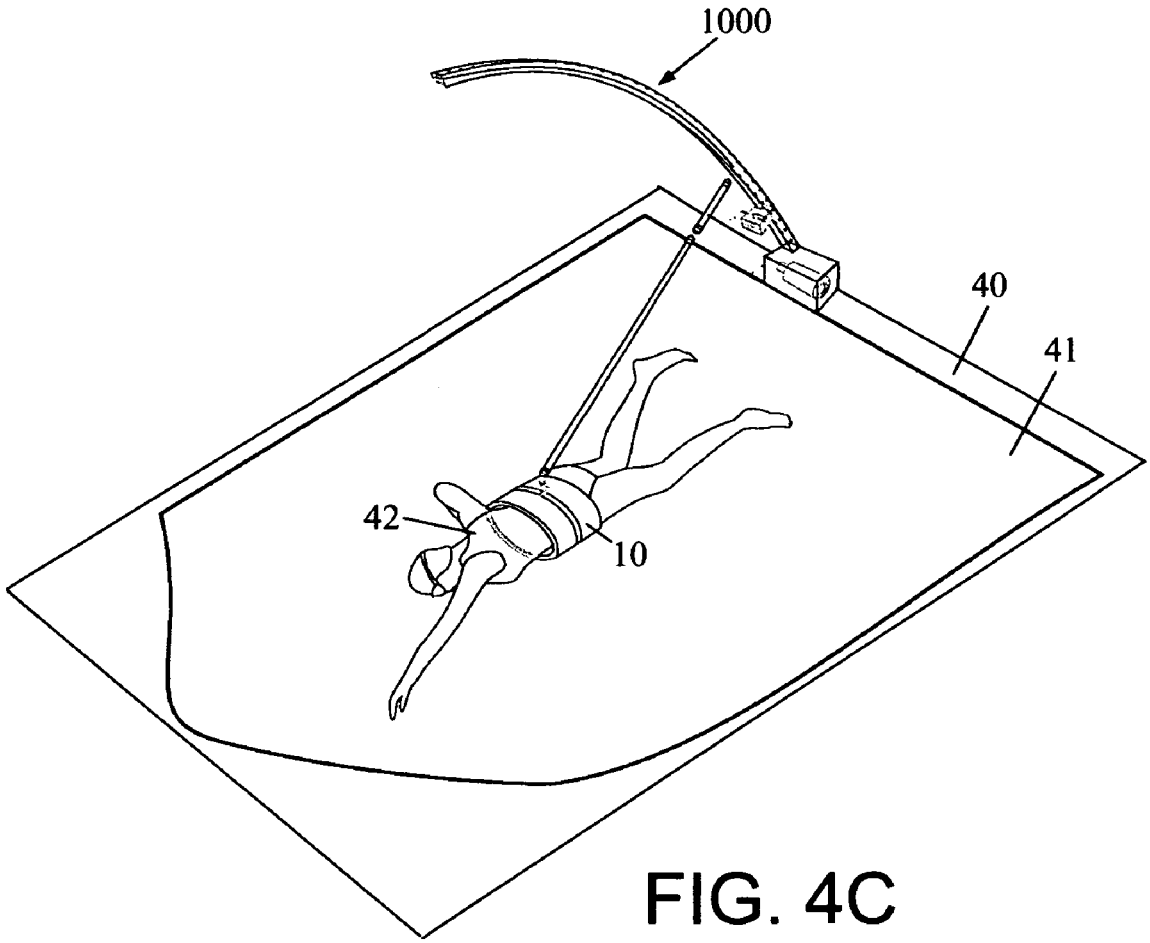

FIG. 1 shows a perspective view of swim training apparatus 1000 that is fabricated in accordance with one or more embodiments of the present invention. As shown in FIG. 1, swim training apparatus 1000 includes: (a) arm 13; (b) positioner 12 (shown in phantom) adapted to be disposed at various positions along at least a portion of arm 13; (c) strap 10 adapted to support at least a portion of user 42 (as shown in FIGS. 4A-4C); and (d) suspension member 11 wherein: (i) first end 111 of suspension member 11 is connected to positioner 12, and second end 112 of suspension member 11 is connected to strap 10.

Figure 5:
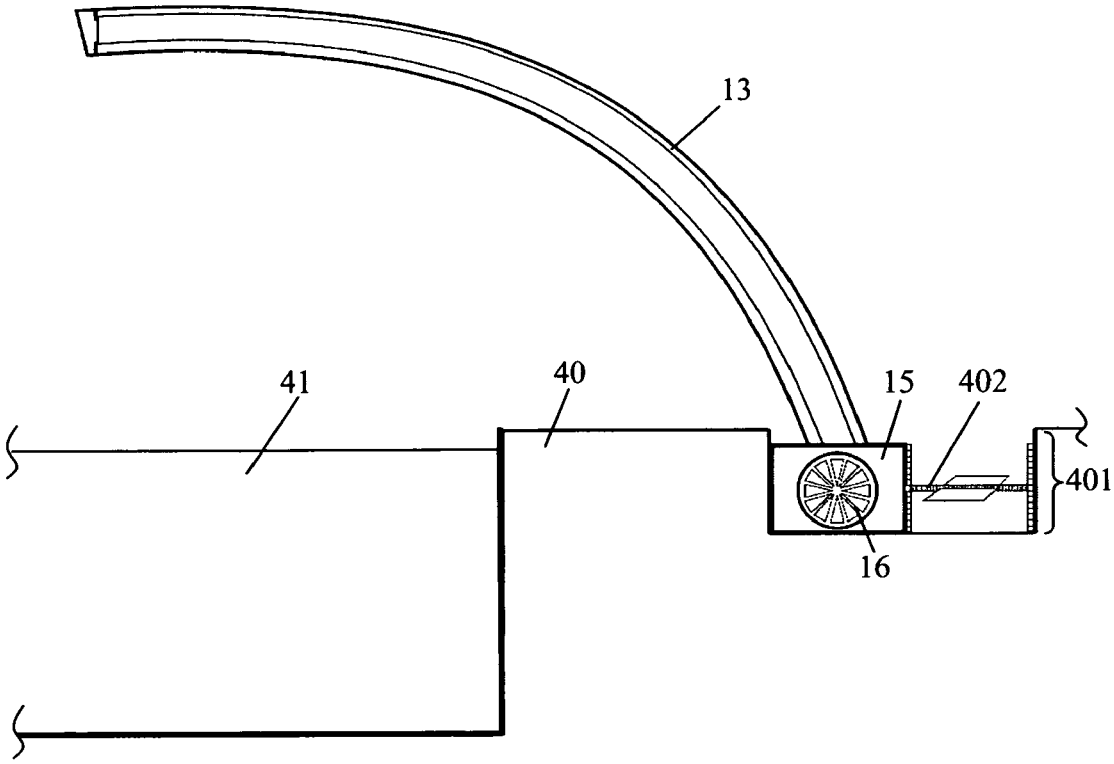
FIG. 5 shows how the swim training apparatus shown in FIG. 1 is installed on a water container in accordance with one or more embodiments of the present invention.

As further shown in FIG. 1, in accordance with one or more embodiments of the present invention, swim training apparatus 1000 further includes: (a) motor 16 disposed inside base 15 (base 15 is adapted to support arm 13); (b) motor controller 17; and (c) control cable 14 (as will be described in detail below, control cable 14 is affixed to positioner 12 to enable control cable 14 to move positioner 12). Arm 13 may be bolted or welded onto base 15, or arm 13 may be fastened to base 15 using any one of a number of fastening methods that are well know in the art. Motor controller 17 controls motor 16 utilizing: (a) an electrical connection (electrical connection lines are not shown in FIG. 1); or (b) a wireless connection. As will be set forth in detail below, in accordance with one or more embodiments of the present invention, motor controller 17 controls the position of positioner 12 by controlling motor 16 and, thereby, movement of control cable 14. In accordance with one or more such embodiments, motor controller 17 is affixed to arm 13, motor 16 is disposed inside base 15, and base 15 is installed on water container 40 (as shown in FIG. 5). In accordance with one or more embodiments of the present invention, control cable 14 may be a chain. In accordance with one or more embodiments of the present invention, control cable 14 comprises a polymeric material such as, for example and without limitation, plastic, and in accordance with one or more further embodiments of the present invention, cable 14 comprises a metallic material such as, for example and without limitation, steel.

In accordance with one or more such embodiments, motor controller 17 is electrically or wirelessly connected to input device 171. Further, in accordance with one or more embodiments of the present invention, input device 171 enables user 42 or an operator to input information such as, for example and without limitation, supporting mode preferences and the weight and height of user 42. Still further, in accordance with one or more such embodiments, input device 171 is connected to a memory device or computer (not shown) which can store information related to supporting mode preferences and the weight and height of user 42 for use as described below. In accordance with one or more such embodiments, the memory device or computer can transmit such information to input device 171 for use as described below. Yet still further, in accordance with one or more embodiments of the present invention, input device 171 includes a sensor that can automatically receive information such as, for example and without limitation, a position, speed, and/or acceleration of strap 10 or user 42. In accordance with one or more such embodiments, input device 171 may include, for example and without limitation, a sensor that detects the position of target 101 as an input, and transmits positional information relating to these inputs to a processor (not shown) in motor controller 17. In accordance with one or more such embodiments, the sensor may be, for example and without limitation, an optical, photoelectric, or ultrasonic sensor. In accordance with one or more such embodiments, target 101 may include a material such as, for example and without limitation, a fluorescent dye that is detectable by the sensor. In accordance with one or more embodiments of the present invention, target 101 may include a device that emits a signal such as, for example and without limitation, an infrared radiation signal that is detectable by the sensor. The processor in motor controller 17 uses the positional information to calculate information relating to the position and/or speed of strap 10 or user 42 in accordance with any one of a number of methods that are well known to those of ordinary skill in the art. In addition, in accordance with one or more embodiments of the present invention, input device 171 may transmit information related to supporting mode preferences and the weight and height of user 42 to the processor. In response to the speed and/or position information, and the information related to supporting mode preferences and the weight and height of user 42, the processor determines a suitable position for positioner 12 along arm 13, and provides information to cause motor controller 17 to control motor 16 appropriately. In response, motor 16 drives cable 14 to move positioner 12 to the suitable position along arm 13.

For example, when using swim training apparatus 1000, typically an immediate or advanced swimmer shows stable and rhythmic movement while a novice swimmer shows unstable and arrhythmic movement. The processor calculates a positional variation during preset time periods such as, for example and without limitation, 30-second time periods. If the positional variation increases in an arrhythmic way, the processor provides first control information to motor controller 17. In response to the first control information, motor controller 17 causes control motor 16 to drive cable 14 to move positioner 12 away from motor 16 to a position determined by the processor, thereby increasing angle 30 (shown in FIGS. 3A-3C) and increasing support for the swimmer. On the other hand, if the positional variation decreases rhythmically, then the processor provides second control information to motor controller 17. In response to the second control information, motor controller 17 causes motor 16 to drive cable 14 to move positioner 12 towards motor 16 to another position determined by the processor, thereby reducing angle 30 (shown in FIGS. 3A-3C) and reducing support for the swimmer. In accordance with one or more embodiments of the present invention, the processor determines positions of positioner 12 based on dynamic information such as swimmer position and speed and/or static information such as swimmer weight, height, skill level, preferences, and previous record of using swim training 1000. In accordance with one or more such embodiments, the processor is pre-programmed and is programmable.

In accordance with one or more embodiments of the present invention, motor controller 17 (including the processor), input device 171, and motor 16 are commercially available, off-the-shelf products that may be obtained in a controller package from suppliers such as, for example and without limitation, Control System in Motion Inc. (www.c-sim.com.tw) of Taipei County, Taiwan.

In accordance with one or more embodiments of the present invention, in use, strap 10 supports user 42 by surrounding a portion of his/her torso (as illustrated in FIGS. 4A-4C). As shown in FIG. 1 strap 10 is connected to suspension member 11 at second end 112 by means of coupling link 116 (in accordance with one or more embodiments of the present invention, coupling link 116 is adapted to move while being connected to suspension member 11 at second end 112), and suspension member 11 is connected to positioner 12 at first end 111 by means of coupling link 121. In accordance with one or more embodiments of the present invention, strap 10 may comprise a floatation structure or material such as, for example and without limitation, a foam material and/or one or more air cells. Further, in accordance with one or more embodiments of the present invention, strap 10 may include a fastener such as, for example and without limitation, a Velcro® fastener that facilitates a user's putting on and taking off strap 10.

As shown in FIG. 1, in accordance with one or more embodiments of the present invention, suspension member 11 includes elastic tube 114. In accordance with one or more such embodiments, restraining cable 115 (shown as a dotted line in FIG. 1) is disposed inside elastic tube 114, and two ends of restraining cable 115 are connected to two ends of elastic tube 114. In accordance with one or more embodiments of the present invention, restraining cable 115 may be less elastic than, and at least as long as, elastic tube 114. As such, restraining cable 115 is adapted to restrain extension of elastic tube 114. As a result, breaking of elastic tube 114 may be prevented.

In accordance with one or more embodiments of the present invention, elastic tube 114 comprises an elastic material such as, for example and without limitation, rubber and/or elastic fibers. Suitable embodiments of elastic tube 114 may be obtained commercially from suppliers such as, for example and without limitation, Geo Hwa Rubber Co., Ltd. (www.georubber.com.tw) of Ilan County, Taiwan. In accordance with one or more embodiments of the present invention, the two ends of restraining cable 115 are connected to the two ends of elastic tube 114 at two metal (such as, for example and without limitation, stainless steel) caps, respectively, which two metal caps may also be adapted to seal the two ends of elastic tube 114. In accordance with one or more alternative embodiments, an elastic cable may be used in place of elastic tube 114 in a configuration wherein restraining cable 115 is disposed beside the elastic cable with the two ends of restraining cable 115 being connected to two ends of the elastic cable.

In accordance with one or more embodiments of the present invention, suspension member 11 includes spring 113. In accordance with one or more such embodiments, and as shown in FIG. 1, spring 113 is connected to elastic tube 114 through link 117. In accordance with one or more such embodiments, spring 113 may be less elastic than elastic tube 114, and as a result, breaking of elastic tube 114 may be prevented. In accordance with one or more such embodiments of the present invention, spring 113 comprises stainless steel. Suitable embodiments of spring 113 can be obtained commercially from suppliers such as, for example and without limitation, Chiu Yao Spring Co., Ltd. (www.cyspring.com.tw) of Taipei County, Taiwan.

In accordance with one or more further embodiments of the present invention, suspension member 11 may include an inelastic rod structure.

As one of ordinary skill in the art can readily appreciate, in any particular embodiment, the dimensions and materials of elastic tube 114, restraining cable 115, and spring 113 may be determined based on considerations such as, for example and without limitation, the weight and strength of a user, the buoyancy of water, and the desired resistance and support to be provided for the user. As is well known, different swim training or exercise applications might have different requirements due to the above-mentioned considerations. The dimension and materials of elastic tube 114, restraining cable 115, and spring 113 for a particular swim training or exercise application may be determined by one of ordinary skill in the art routinely and without undue experimentation utilizing any one of a number of methods that are well known to one of ordinary skill in the art such as, for example and without limitation, mathematical modeling, optimization, and/or computer simulation.

Figure 2A:
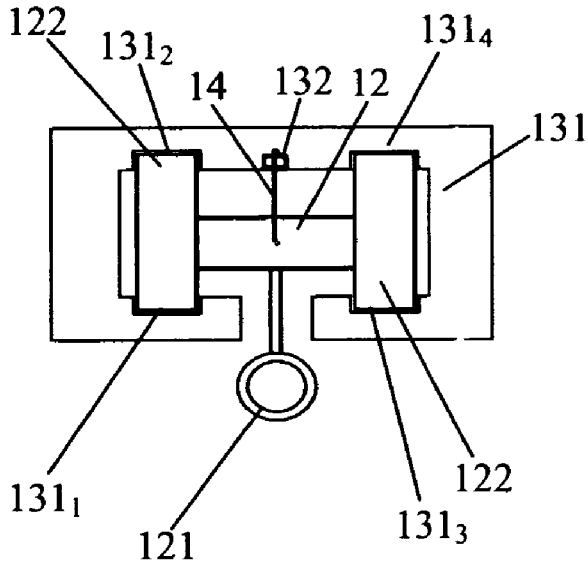
FIGS. 2A and 2B show a front view and a side view of a cross section, respectively, of a positioner and an end portion of an arm of the swim training apparatus shown in FIG. 1.
Figure 2B:
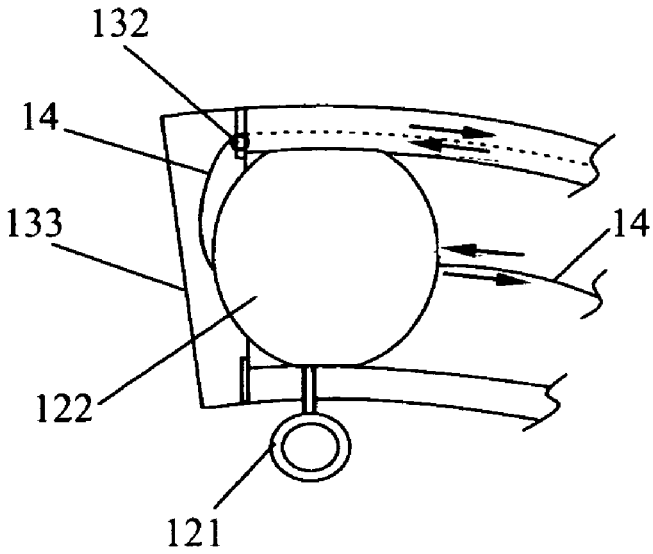

FIGS. 2A and 2B show a front view and a side view of a cross section, respectively, of positioner 12 and an end portion of arm 13. In accordance with one or more embodiments of the present invention, as shown in FIG. 2A, arm 13 includes rail 131 which has grooves $\mathbf{131}_1$-$\mathbf{131}_4$. Further, in accordance with one or more such embodiments of the present invention, as shown in FIG. 2A, positioner 12 includes wheels 122 which are mounted on rail 131 (one wheel being disposed in grooves $\mathbf{131}_1$ and $\mathbf{131}_2$, and the other wheel being disposed in grooves $\mathbf{131}_3$ and $\mathbf{131}_4$). Wheels 122 are adapted to roll along rail 131 to enable positioner 12 to move along arm 13. As shown in FIG. 2B, in accordance with one or more embodiments of the present invention, arm 13 further includes cover 133 that covers an end of arm 13 to prevent positioner 12 from moving out of arm 13.

As further shown in FIG. 2B, in accordance with one or more embodiments of the present invention, control cable 14 is connected to two sides of positioner 12 to enable control cable 14 to pull positioner 12 in two directions along arm 13. In particular, motor controller 17 may activate motor 16 to pull control cable 14: (a) in a first direction to cause positioner 12 to move along at least a portion of arm 13 towards motor 16; and (b) in a second direction to cause positioner 12 to move along at least a portion of arm 13 away from motor 16. Motor 16 may drive movement of control cable 14 using one or more methods that are well known in the art such as, for example and without limitation, utilizing: (a) a pulley coupled to a shaft of motor 16, which pulley couples force to control cable 14 by means of friction; and (b) a gear wheel coupled to a shaft of motor 16, which gear wheel couples force to control cable 14, which control cable 14 is, for example, in a chain or caterpillar track configuration.

As further shown in FIG. 2B, arm 13 further includes pulley 132. Pulley 132 rotates whenever control cable 14 is driven by motor 16 during operation of swim training apparatus 1000, thereby reducing wear of control cable 14.

In accordance with one or more further embodiments of the present invention, a first end of control cable 14 is connected to positioner 12 (at a side of positioner 12 that is close to cover 133), and a second end of control cable 14 is affixed to a perimeter of a shaft of motor 16. In accordance with one or more such embodiments, motor controller 17 may: (a) activate motor 16 to rotate the shaft in a first direction to roll up control cable 14 to cause positioner 12 to move along at least a portion of arm 13 towards cover 133 (and away from motor 16); and (b) activate motor 16 to rotate the shaft in a second direction or de-activate motor 16 to release control cable 14 and enable the weight of suspension member 11 and user 42 (as shown in FIGS. 4A-4C) to move positioner 12 along at least a portion of arm 13 away from cover 133 (and towards motor 16).

In accordance with one or more still further embodiments of the present invention that do not include motor 16 and motor controller 17, movement of positioner 12 may be driven by a human, an animal, or a robotic operator by, for example and without limitation, (a) pulling and releasing cable 14, and (b) lifting positioner 12 from, and disposing positioner 12 into, discrete positioner rests along at least a portion of arm 13, as will be described with reference to FIG. 6.

Figure 3A:
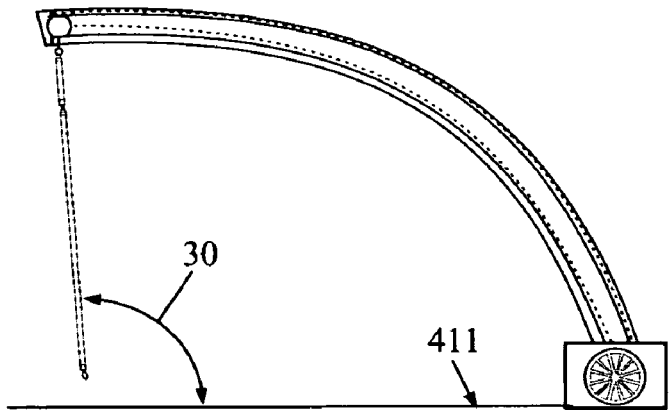
FIGS. 3A, 3B, and 3C show the positioner shown in FIGS. 2A and 2B disposed at three different positions along the arm shown in FIG. 1.
Figure 3B:
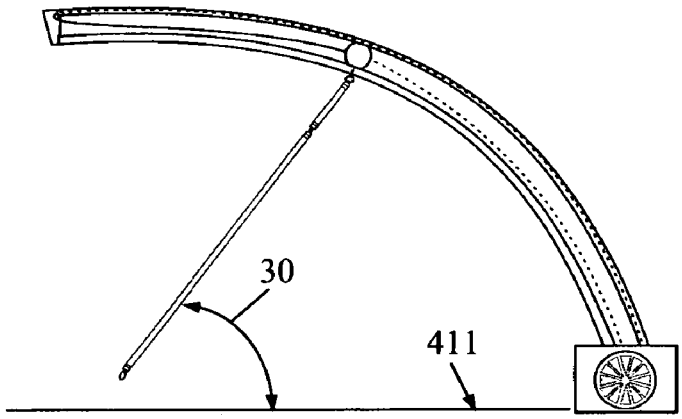
Figure 3C:
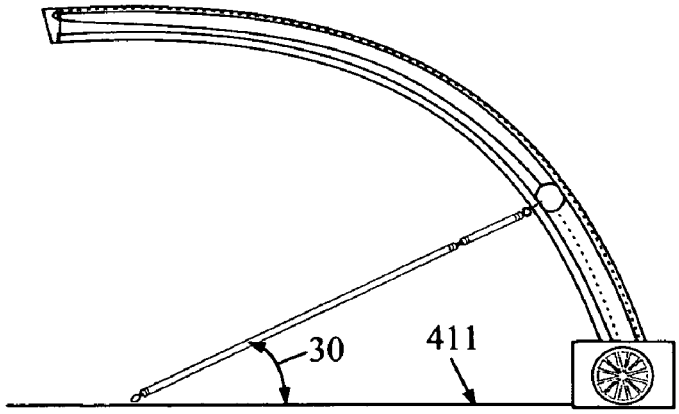

As further shown in FIGS. 3A-3C, in accordance with one or more embodiments of the present invention, arm 13 comprise a structure that is in the shape of a convex arc. In accordance with one or more such embodiments, the shape of arm 13 is such that an angle formed between a tangent to arm 13 and water surface 411 decreases gradually as one travels from a bottom portion of arm 13 (i.e., near base 15) to a top portion of arm 13 (i.e., away from base 15). For example and without limitation, near the bottom portion of arm 13 the angle may be at least 30, 45, or 60 degrees, and near the top portion of arm 13 the angle may be no more than 10 degrees. As one can readily appreciate from FIGS. 3A-3C, as positioner 12 moves along arm 13 angle 30 between suspension member 11 and water surface 411 changes.

With reference to FIGS. 4A-4C, as one of ordinary skill in the art can readily appreciate, in any particular embodiment, the dimensions, shape, structure, and material of arm 13 may be determined based on considerations such as, for example and without limitation, the maximum weight of a user, a range of swimming skill levels of the user, the buoyancy of water, and the size of a water container. As is well known, different swim training or exercise applications might have different requirements due to the above-mentioned considerations. The dimensions, shape, structure, and material of arm 13 for a particular swim training or exercise application may be determined by one of ordinary skill in the art routinely and without undue experimentation utilizing any one of a number of methods that are well known to one of ordinary skill in the art such as, for example and without limitation, finite element modeling and computer simulation.

In accordance with one or more embodiments of the present invention, arm 13 comprises a robust material such as, for example and without limitation, carbon fiber. In accordance with one or more embodiments of the present invention, arm 13 comprises a stiff material such as, for example and without limitation, stainless steel. Arm 13 can readily be fabricated by a machine shop using processes that are well known in the art such as, for example and without limitation, molding and forming. Suitable components for arm 13 can be obtained commercially from glide rail suppliers such as, for example and without limitation, Control System in Motion Inc. (www.csim.com.tw) of Taipei County, Taiwan.

As shown in FIGS. 4A-4C, in accordance with one or more embodiments of the present invention, swim training apparatus 1000 is adapted to be installed on water container 40. Swim training apparatus 1000 may be installed so that arm 13 extends over water 41, and at least a portion of strap 10 contacts or is immersed in water 41 to enable user 42 to swim in water 41. FIGS. 3A-3C show three different positions of positioner 12, and FIGS. 4A-4C show three exemplary supporting modes for user 42 that correspond to the three different positions of positioner 12 shown in FIGS. 3A, 3B, and 3C, respectively.

In accordance with one or more embodiments of the present invention, FIGS. 3A and 4A correspond to a first supporting mode for user 42 where positioner 12 is driven to, or is disposed at, a position near a top portion of arm 13. In the first supporting mode, angle 30 shown in FIG. 3A is ninety degrees or nearly ninety degrees, and suspension member 11 supports user 42 at an appropriate level near the surface of water 41 through strap 10. As a result, user 42 is completely supported even with minimal or no forward swimming. In accordance with one or more such embodiments, the first supporting mode may be appropriate for use by a novice swimmer.

In accordance with one or more embodiments of the present invention, FIGS. 3B and 4B correspond to a second supporting mode for user 42 where positioner 12 is driven to, or is disposed at, an intermediate position along arm 13. In accordance with one or more such embodiments, the weights of user 42, strap 10, and suspension member 11 outweigh the buoyancy of water 41. Therefore gravity tends to pull user 42 under the surface of water 41, and would make angle 30 change from the value illustrated in FIG. 3B towards ninety degrees if user 42 does not swim forward. However, if user 42 swims and pulls suspension member 11 forward, causing angle 30 to be less than ninety degrees, a reaction force exerted by suspension member 11 on user 42 will have a vertical, upward component, with the help of the buoyancy of water 41, to keep user 42 afloat at an appropriate level near the surface of water 41. In accordance with one or more such embodiments, the second supporting mode may be appropriate for use by an intermediate swimmer.

In accordance with one or more embodiments of the present invention, FIGS. 3C and 4C correspond to a third supporting mode for user 42 where positioner 12 is driven to, or is disposed at, a position near a lower portion of arm 13. In accordance with one or more such embodiments, the weights of user 42, strap 10, and suspension member 11 outweigh the buoyancy of water 41. Thus, as in the above-mentioned second supporting mode, user 42 needs to swim and pull suspension member 11 forward in order to generate an upward force component from suspension member 11 to stay afloat. As one can readily appreciate, when user 42 is afloat, angle 30 is smaller in the third supporting mode than it is in the second supporting mode. Therefore, as one of ordinary skill in the art can readily appreciate, in the third supporting mode, in order to generate a sufficient upward force component, user 42 needs to exert a relatively larger force on suspension member 11 than is provided in the second supporting mode by swimming forward more forcefully. In accordance with one or more such embodiments, the third supporting mode may be appropriate for a relatively more advanced or stronger swimmer.

FIG. 5 shows how swim training apparatus 1000 is installed on a water container in accordance with one or more embodiments of the present invention. As shown in FIG. 5, base 15 of swim training apparatus 1000 is disposed inside receptacle 401 near an edge of water container 40. Further, screw jack 402 is adapted to secure base 15 in place by pushing base 15 against a wall of receptacle 401. As a result, a substantial portion of arm 13 extends above water 41 to enable operation of swim training apparatus 1000 as described above with reference to FIGS. 3A-3C and 4A-4C. In accordance with one or more embodiments of the present invention, base 15 includes a waterproof material to prevent motor 16 from being exposed to water. Further, receptacle 401 may include a drainage system to prevent water accumulation.

Figure 6:
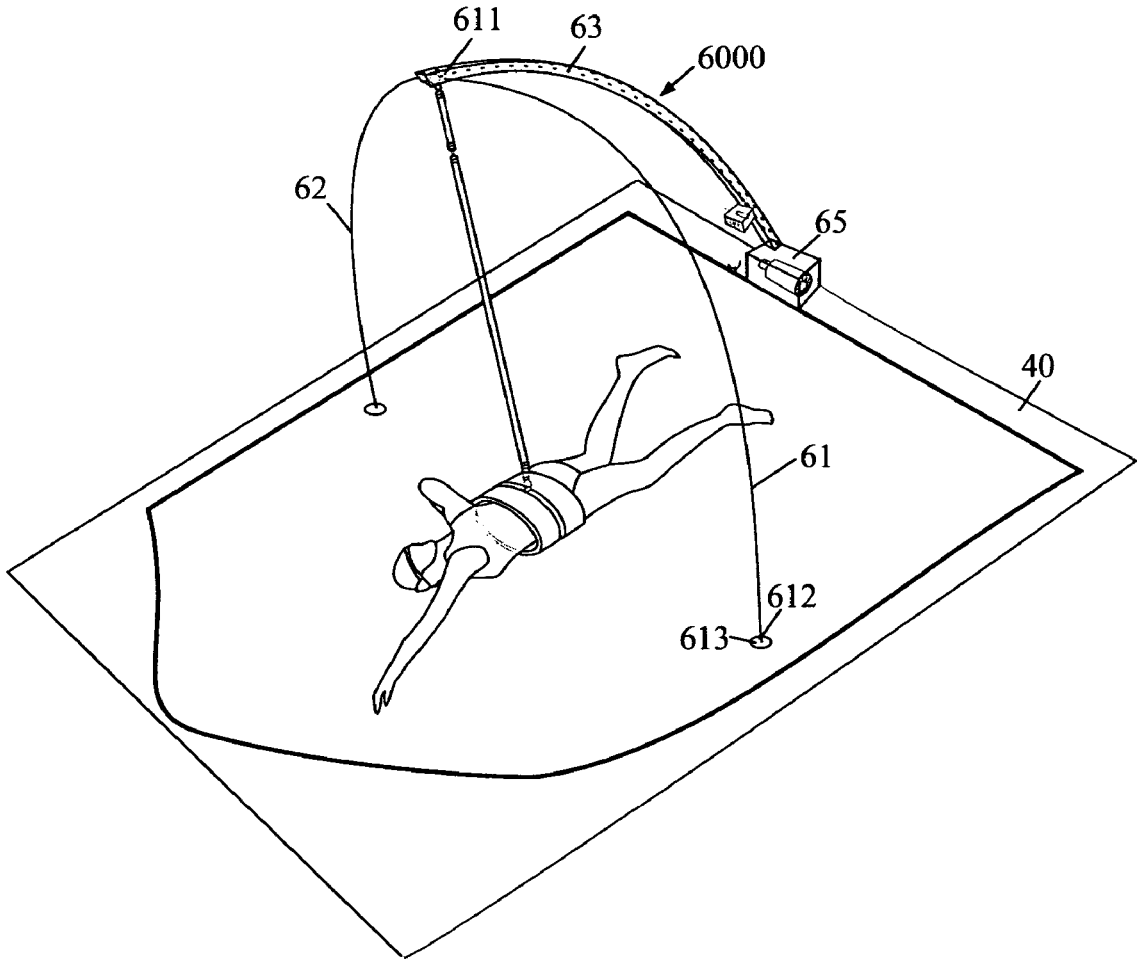
FIG. 6 shows a perspective view of a swim training apparatus that is fabricated and installed in accordance with one or more further embodiments of the present invention.

FIG. 6 shows a perspective view of swim training apparatus 6000 that is fabricated and installed in accordance with one or more further embodiments of the present invention. As shown in FIG. 6, swim training apparatus 6000 includes components similar to those of swim training apparatus 1000 shown in FIG. 1. In addition, swim training apparatus 6000 includes support member 61 that may include a stiff material such as, for example and without limitation, stainless steel. Suitable embodiments of support member 61 can be obtained commercially from stainless steel suppliers such as, for example and without limitation, Lung An Stainless Ind. Co., Ltd. (www.lungan.com.tw) of Taipei County, Taiwan or they may readily made by machine shops in accordance with any one of a number of methods well known in the art. In accordance with one or more such embodiments, first end 611 of support member 61 is connected to arm 63, and second end 612 of support member 61 is connected to a bottom of (inside) water container 40. In accordance with one or more alternative embodiments of the present invention that are not shown, second end 612 is connected to an edge of water container 40. In accordance with one or more embodiments of the present invention, second end 612 includes suction pad 613 or a suction cup, and a method of installing swim training apparatus includes affixing suction pad 613 or the suction cup to a surface of water container 40. Suitable embodiments of suction pad 613 or the suction cup can be obtained commercially from suppliers such as, for example and without limitation, Hsin Tai Shing Rubber Industry Co., Ltd. (www.hts-rubber.com) of Kaohsiung City, Taiwan and Anver Corporation. (www.anver.com) of Hudson, Mass. In accordance with one or more embodiments of the present invention using support member 61, base 65 is connected to an edge of water container 40 utilizing one or more hooks or suction cups or suction pads (not shown). In accordance with one or more embodiments of the present invention, swim training apparatus 6000 includes one or more support members such as, for example and without limitation, support member 62 shown in FIG. 6.

Figure 7:
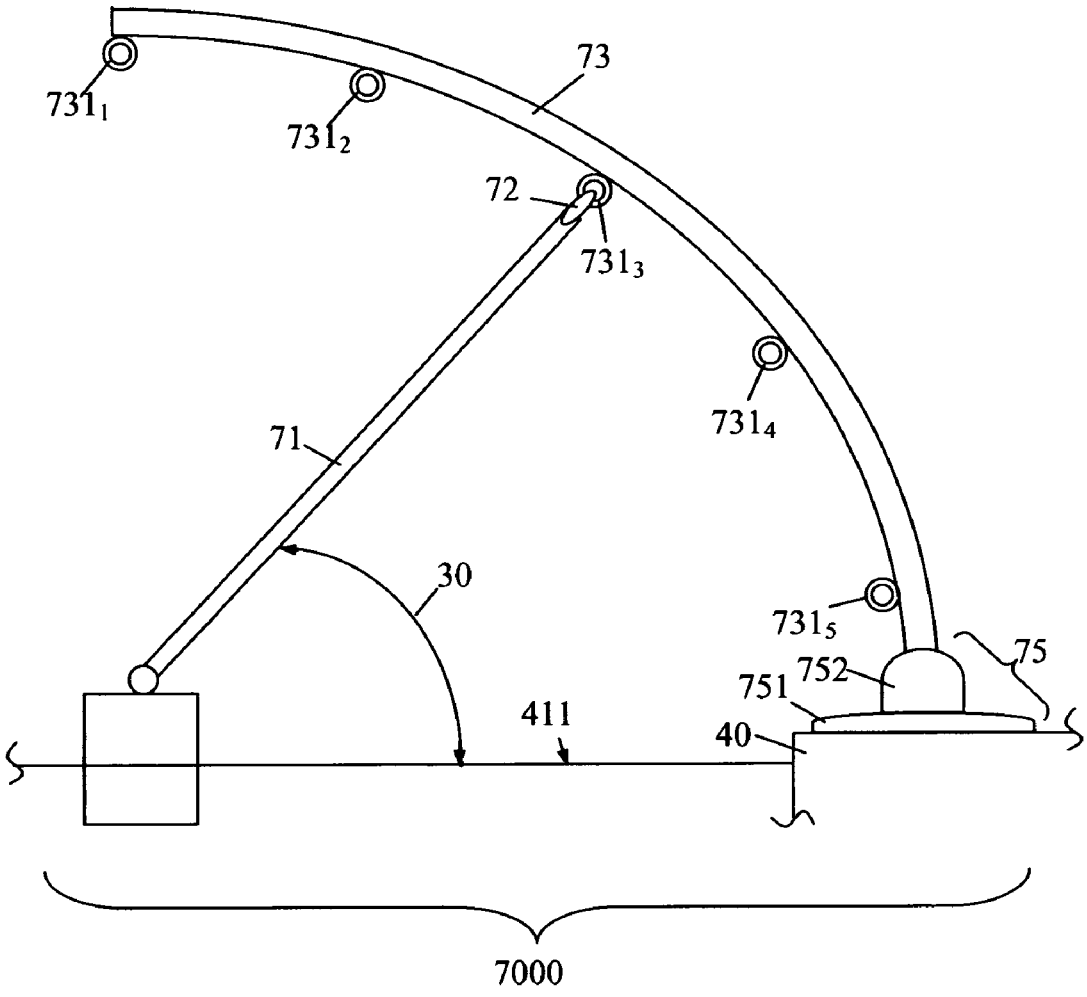
FIG. 7 shows a side view of a swim training apparatus that is fabricated and installed in accordance with one or more still further embodiments of the present invention.
Figure 8:
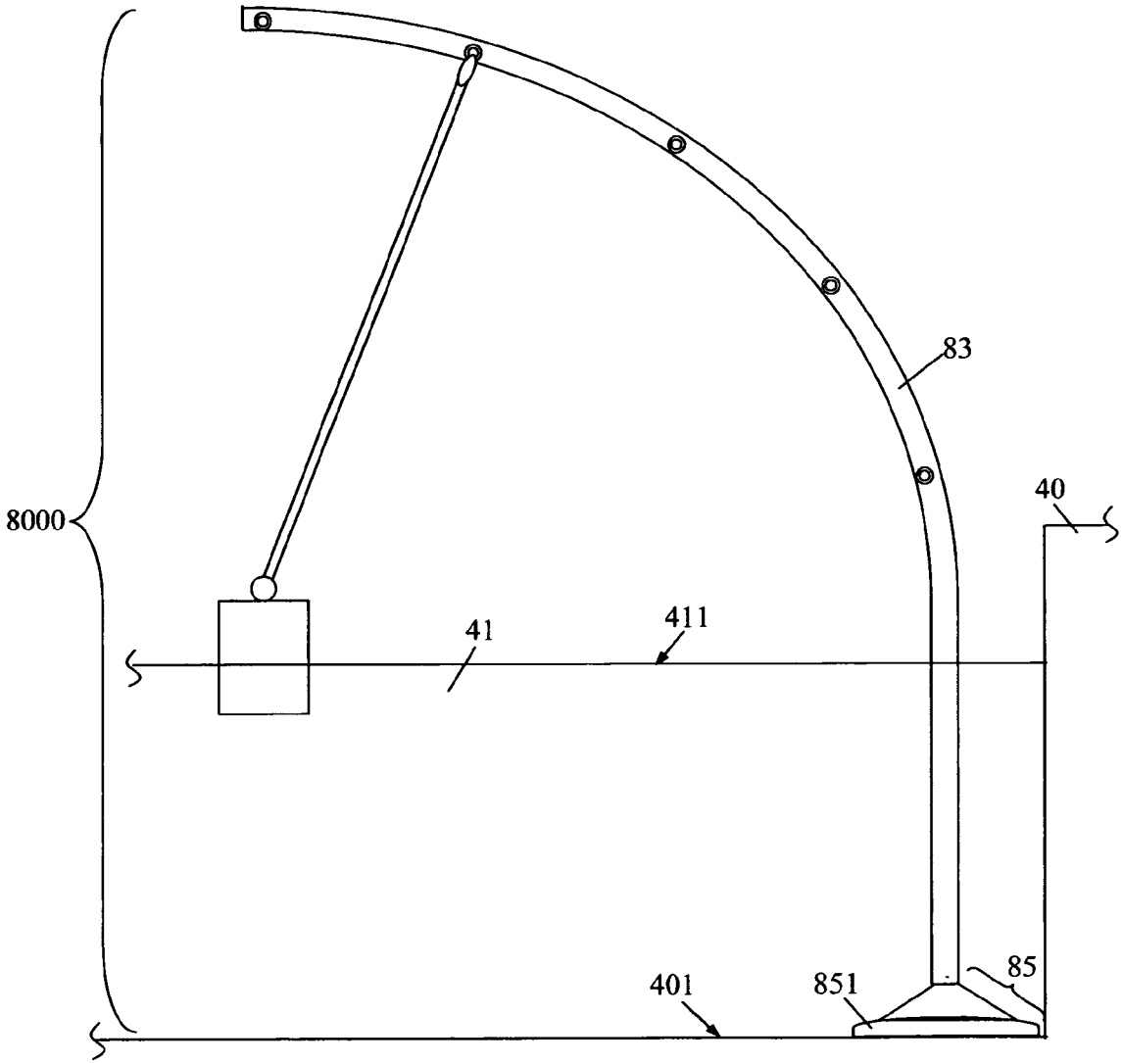
FIG. 8 shows a side view of a swim training apparatus that is fabricated and installed in accordance with one or more yet still further embodiments of the present invention.

FIG. 7 shows a side view of swim training apparatus 7000 that is fabricated and installed in accordance with one or more still further embodiments of the present invention. Swim training apparatus 7000 includes a plurality of positioner couplings such as, for example and without limitation, positioner couplings $\mathbf{731}_1$-$\mathbf{731}_5$ shown in FIG. 7. The positioner couplings are disposed along arm 73, and are adapted to secure positioner 72 at various positions along arm 73 to change angle 30 between suspension 71 and water surface 411, thereby changing user supporting modes. In accordance with one or more embodiments of the present invention, a positioner coupling may include a coupling or fastening component such as, for example and without limitation, a link, a hook, a pin, a bolt, a nut, or a latch. Further, in accordance with one or more embodiments of the present invention, a positioner coupling may be a hole fabricated in arm 83 as shown in FIG. 8 or a notch fabricated on an arm of a swim training apparatus (not shown). Still further, in accordance with one or more embodiments of the present invention, positioner 72 may also include a coupling or fastening component such as, for example and without limitation, a hook, a link, a pin, a bolt, a nut, or a latch. Suitable embodiments of the positioner coupling and positioner 72 may be obtained commercially from suppliers such as, for example and without limitation, mechanical parts suppliers listed on Taiwan Industry Product Information Network website (www.industry.net.tw) and GlobalSpec website (www.globalspec.com) or readily made by machine shops well known in the art.

As further shown in FIG. 7, in accordance with one or more embodiments of the present invention, swim training apparatus 7000 includes base 75, which base 75 is connected to arm 73 and is connected to an edge of water container 40. In accordance with one or more such embodiments, base 75 includes suction pad 751 or a suction cup that is adapted to be affixed to a surface of water container 40 under atmospheric pressure. Suitable embodiments of suction pad 751 or the suction cup can be obtained commercially from suppliers such as, for example and without limitation, Hsin Tai Shing Rubber Industry Co., Ltd. (www.hts-rubber.com) of Kaohsiung City, Taiwan and Anver Corporation. (www.anver.com) of Hudson, Mass. Further, in accordance with one or more embodiments of the present invention, base 75 includes reinforcement member 752, which reinforcement member 752 includes a high density material such as, for example and without limitation, stainless steel and is adapted to support and stabilize arm 75.

FIG. 8 shows a side view of swim training apparatus 8000 that is fabricated and installed in accordance with one or more yet still further embodiments of the present invention. As shown in FIG. 8, swim apparatus 8000 includes suction base 85 that is adapted to support arm 83. In accordance with one or more such embodiments, suction base 85 includes suction cup 851, which suction cup 851 is affixed to bottom surface 401 on the inside of water container 40 and under water surface 411 so that water 41 exerts hydraulic pressure thereon. In accordance with one or more such embodiments, suction base 85 is shaped so that water 41 exerts sufficient hydraulic pressure thereon to securely affix it to bottom surface 401 while enabling suction base to support arm 83 in a manner suitable for operability of swim training apparatus 8000. An appropriate shape and dimensions of suction base 85 may be determined by one of ordinary skill in the art routinely and without undue experimentation utilizing any one of a number of methods that are well known to one of ordinary skill in the art such as, for example and without limitation, computer modeling, simulation, and optimization.

With reference to FIG. 8, in accordance with one or more embodiments of the present invention, a method of installing swim training apparatus 8000 includes: (a) providing suction cup 851 or a suction pad to be a part of swim training apparatus 8000; and (b) affixing suction cup 851 or the suction pad to bottom surface 401, which bottom surface 401 is inside water container 40.

The embodiments of the present invention described above are exemplary. Many changes and modifications may be made to the disclosure recited above, while remaining within the scope of the invention. The scope of the invention should, therefore, be determined not with reference to the above description, but instead should be determined with reference to the appended claims along with their full scope of equivalents.

What is claimed is:

1. A swim training apparatus comprising:

a base;

a motor;

an arc-shaped arm extended from the base;

a positioner connected to the arm and configured to move along at least a portion of the arm; and a suspension member having a first end connected to the positioner and an opposite end connected to a strap wherein the strap is adapted to surround at least a portion of a user to support the user exercising in a body of water, and the motor moves the positioner along the arm depending on the position of the strap, and thus the user during exercise, relative to the base such that support for the user provided by the suspension member changes as the location of the positioner changes along the arm.

2. The swim training apparatus of claim 1 wherein an angle between the suspension member and a level surface is approximately 90 degrees when the positioner is at a first position, and the angle is less than 45 degrees when the positioner is at a second position, the second position being closer to the base than the first position.

3. A motor connected to a cable or chain, thre cable or chain connected to the positioner, configured to drive the movement of the positioner to change an angle between the suspension member and a level surface.

4. The swim training apparatus of claim 3 further comprising a motor controller that directs operation of the motor.

5. The swim training apparatus of claim 4 wherein the motor controller receives a position of the strap as an input.

6. The swim training apparatus of claim 4 further comprising an input device that transfers information to the motor controller.

7. The swim training apparatus of claim 6 wherein the position of the strap is determined periodically.

8. The swim training apparatus of claim 1 wherein the arm comprises a rail; and the positioner is mounted on, and is adapted to move along, the rail.

9. The swim training apparatus of claim 1 wherein the positioner is configured to move in at least two directions along the arm.

10. The swim training apparatus of claim 1 wherein an angle formed between a tangent to the arm at the positioner and a level surface gradually decreases as the positioner travels from a bottom portion of the arm to a top portion of the arm.

11. The swim training apparatus of claim 1 wherein the strap comprises a floatation structure.

12. The swim training apparatus of claim 11 wherein the floatation structure comprises at least one of a foam material and one or more air cells.

13. The swim training apparatus of claim 1 wherein at least one of a weight of the suspension member and a weight of the user moves the positioner along the arm when the motor for driving the movement is de-activated.

14. The swim training apparatus of claim 1 wherein the positioner comprises a wheel.

15. The swim training apparatus of claim 1 wherein the suspension member further comprises a spring.

16. The swim training apparatus of claim 1 wherein the suspension member further comprises a rod.

17. The swim training apparatus of claim 1 wherein the suspension member further comprises a cable.

18. The swim training apparatus of claim 1 wherein the suspension member further comprises:

an elastic tube;

and a cable disposed inside the elastic tube;

wherein the cable is less elastic than the elastic tube; and two ends of the cable are connected, respectively, to two ends of the elastic tube.

19. The swim training apparatus of claim 18 wherein the cable is as long as or longer than the elastic tube when the elastic tube is not stretched.

20. The swim training apparatus of claim 18 wherein the suspension member further comprises a spring that is connected to an end of the elastic tube.

21. The swim training apparatus of claim 1 further comprising a support member, wherein a first end of the support member is connected to the arm, and a second end of the support member is connected to a water container.

22. The swim training apparatus of claim 21 wherein the second end of the support member comprises a suction cup or suction pad.

23. The swim training apparatus of claim 1 wherein the base comprises a suction cup or suction pad.

* * * * *